US008471450B2

(12) United States Patent
Walker, Jr. et al.

(10) Patent No.: US 8,471,450 B2
(45) Date of Patent: Jun. 25, 2013

(54) CERAMIC ELECTRODE, IGNITION DEVICE THEREWITH AND METHODS OF CONSTRUCTION THEREOF

(75) Inventors: William J. Walker, Jr., Toledo, OH (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/243,543

(22) Filed: Sep. 23, 2011

(65) Prior Publication Data

US 2012/0013240 A1 Jan. 19, 2012

Related U.S. Application Data

(62) Division of application No. 12/200,244, filed on Aug. 28, 2008, now Pat. No. 8,044,561.

(51) Int. Cl.
*H01T 13/20* (2006.01)

(52) U.S. Cl.
USPC ..... 313/141; 313/11.5; 313/145

(58) Field of Classification Search
USPC ..... 313/118–145; 123/32, 41, 143 R, 123/146.5 R, 169 P, 260, 280, 169 R, 169 EL, 123/310
See application file for complete search history.

(56) References Cited

U.S. PATENT DOCUMENTS

| | | | | |
|---|---|---|---|---|
| 3,673,452 | A | 6/1972 | Brennen | |
| 3,725,715 | A | 4/1973 | Krow | |
| 4,261,085 | A | 4/1981 | Nishio | |
| 4,369,343 | A | 1/1983 | Sone et al. | |
| 4,396,855 | A | 8/1983 | Imai et al. | |
| 4,400,643 | A | 8/1983 | Nishio | |
| 4,406,968 | A * | 9/1983 | Friese et al. | 313/136 |
| 4,427,915 | A | 1/1984 | Nishio | |
| 4,519,784 | A | 5/1985 | Pollner | |
| 4,601,848 | A * | 7/1986 | Sakai et al. | 252/503 |
| 4,659,960 | A | 4/1987 | Toya | |
| 4,713,582 | A * | 12/1987 | Yamada et al. | 315/58 |
| 5,493,171 | A * | 2/1996 | Wood et al. | 313/141 |
| 6,160,342 | A | 12/2000 | Nishikawa et al. | |
| 6,533,628 | B1 | 3/2003 | Matsutani | |
| 6,863,963 | B2 * | 3/2005 | Abukawa | 428/212 |
| 2005/0284859 | A1 | 12/2005 | Konishi | |
| 2007/0057613 | A1 * | 3/2007 | Brady et al. | 313/141 |
| 2007/0080618 | A1 | 4/2007 | Torii et al. | |
| 2008/0143229 | A1 | 6/2008 | Walker | |
| 2010/0052497 | A1 | 3/2010 | Walker | |
| 2010/0052498 | A1 | 3/2010 | Walker, Jr. | |
| 2010/0052499 | A1 | 3/2010 | Walker, Jr. | |

FOREIGN PATENT DOCUMENTS

| | | | |
|---|---|---|---|
| CN | 1180983 | A | 5/1998 |
| JP | 55081477 | * | 6/1980 |

* cited by examiner

*Primary Examiner* — Donald Raleigh
(74) *Attorney, Agent, or Firm* — Robert L. Stearns; Dickinson Wright, PLLC

(57) ABSTRACT

A spark plug, a center electrode therefore and method of construction is provided. The spark plug has a generally annular ceramic insulator extending between a terminal end and a nose end. A conductive shell surrounds at least a portion of the ceramic insulator and a ground electrode having a ground electrode sparking surface is operatively attached to the shell. An elongate center electrode has a body extending between opposite ends, wherein the body is compacted and sintered of a conductive or semi-conductive ceramic material. One of the electrode ends provides a center electrode sparking surface to provide a spark gap between the center electrode sparking surface and the ground electrode sparking surface.

28 Claims, 2 Drawing Sheets

CERAMIC ELECTRODE, IGNITION DEVICE THEREWITH AND METHODS OF CONSTRUCTION THEREOF

CROSS REFERENCE TO RELATED APPLICATIONS

This divisional patent application claims priority to U.S. patent application Ser. No. 12/200,244 filed Aug. 28, 2008 now U.S. Pat. No. 8,044,561 entitled "Ceramic Electrode, Ignition Device Therewith And Methods Of Construction Thereof," the entire disclosure of which is hereby incorporated by reference and relied upon.

BACKGROUND OF THE INVENTION

1. Field of the Invention

The invention relates generally to ignition devices for internal combustion engines, and more particularly to electrodes therefor.

2. Related Art

A spark plug is a spark ignition device that extends into the combustion chamber of an internal combustion engine and produces a spark to ignite a mixture of air and fuel. Spark plugs typically have an outer ceramic insulator, which is fabricated and fired separately from other components of the spark plug, a center electrode extending partially through the insulator to a firing tip, and a ground electrode extending from an outer metal shell. A separate resistor component is commonly coupled to an end of the electrode within the insulator opposite the firing end of the electrode. The resistor acts to suppress radio frequency (RF) electromagnetic radiation, which if left unchecked, can affect the transmission of other electrical signals, including inferring with radio signals. Typically, the closer the resistor is located to the firing gap between the spaced center and ground electrode firing ends the better, as this is where the spark is produced, thus being a primary location for the generation of RF electromagnetic radiation.

Recent advancements in engine technology are resulting in higher engine operating temperatures to achieve improved engine efficiency and performance. These higher operating temperatures have an adverse affect on the spark plugs by diminishing their useful life. In particular, the higher temperatures are pushing the spark plug electrodes to the very limits of their material capabilities, and in some cases beyond the limits, thereby resulting in failure of the electrode. Presently, Ni-based alloys, including nickel-chromium-iron alloys specified under UNS N06600, such as those sold under the trade names Inconel 600®, Nicrofer 7615®, and Ferrochronin 600®, are in wide use as spark plug electrode materials. These electrodes are typically expected to last up to about 30,000 miles in service, and thereafter, generally need to be replaced.

As is well known, the resistance to high temperature oxidation of these Ni-based nickel-chromium-iron alloys decreases as their operating temperature increases. Since combustion environments are highly oxidizing, corrosive wear including deformation and fracture caused by high temperature oxidation and sulfidation can result and is particularly exacerbated at the highest operating temperatures. At the upper limits of operating temperature (e.g., 1400° F. or higher), tensile, creep rupture and fatigue strength also have been observed to decrease significantly which can result in deformation, cracking and fracture of the electrodes. Depending on the electrode design, specific operating conditions and other factors, these high temperature phenomena may contribute individually and collectively to undesirable growth of the spark plug gap, which increases the voltage required to cause sparking and diminishes performance of the ignition device and associated engine. In extreme cases, failure of the electrode, ignition device and associated engine can result from electrode deformation and fracture resulting from these high temperature phenomena.

Some known attempts to combat failure of electrodes from exposure to the increasing temperatures in high performance engines include fabricating the electrodes from precious metals, such as platinum or iridium. Although the life in service of these electrodes can increase the useful life of the electrode, generally up to about 80,000-100,000 miles, they still typically need to be replaced within the lifetime of the vehicle. Further, these electrodes can be very costly to construct.

Accordingly, there is a need for spark plugs that have electrodes exhibiting an increased useful life in high temperature engine environments; have resistance to high temperature oxidation, sulfidation and related corrosive and erosive wear mechanisms; suppress RF electromagnetic radiation; have sufficient high temperature tensile, creep rupture and fatigue strength; resist cracking and fracture sufficient for use in current and future high temperature/high performance spark ignition devices, and are economical in manufacture.

SUMMARY OF THE INVENTION

A center electrode for a spark ignition device has an elongate body constructed of a conductive or semi-conductive ceramic material.

According to another aspect of the invention, a spark plug has a generally annular ceramic insulator extending along a longitudinal axis between a terminal end and a nose end. A conductive shell surrounds at least a portion of the ceramic insulator and a ground electrode is operatively attached to the shell, wherein the ground electrode has a ground electrode sparking surface. A center electrode has an elongate body extending along a longitudinal axis between opposite ends. One of the electrode ends provides a center electrode sparking surface. The center electrode sparking surface and the ground electrode sparking surface providing a spark gap. The body of the center electrode is constructed of a conductive or semi-conductive ceramic material.

In accordance with another aspect of the invention, a method of constructing a spark plug is provided. The method includes compacting a ceramic material to form a generally annular ceramic insulator having a central passage extending between a terminal end and a nose end; forming a conductive shell configured to surround at least a portion of the ceramic insulator; forming a ground electrode; providing a ground electrode attached to the shell; compacting a ceramic material to form an elongate center electrode; sintering the compacted ceramic materials of the insulator and the center electrode, and disposing the insulator and the center electrode in the shell.

BRIEF DESCRIPTION OF THE DRAWINGS

These and other aspects, features and advantages of ceramic electrode and spark plug constructed in accordance with the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
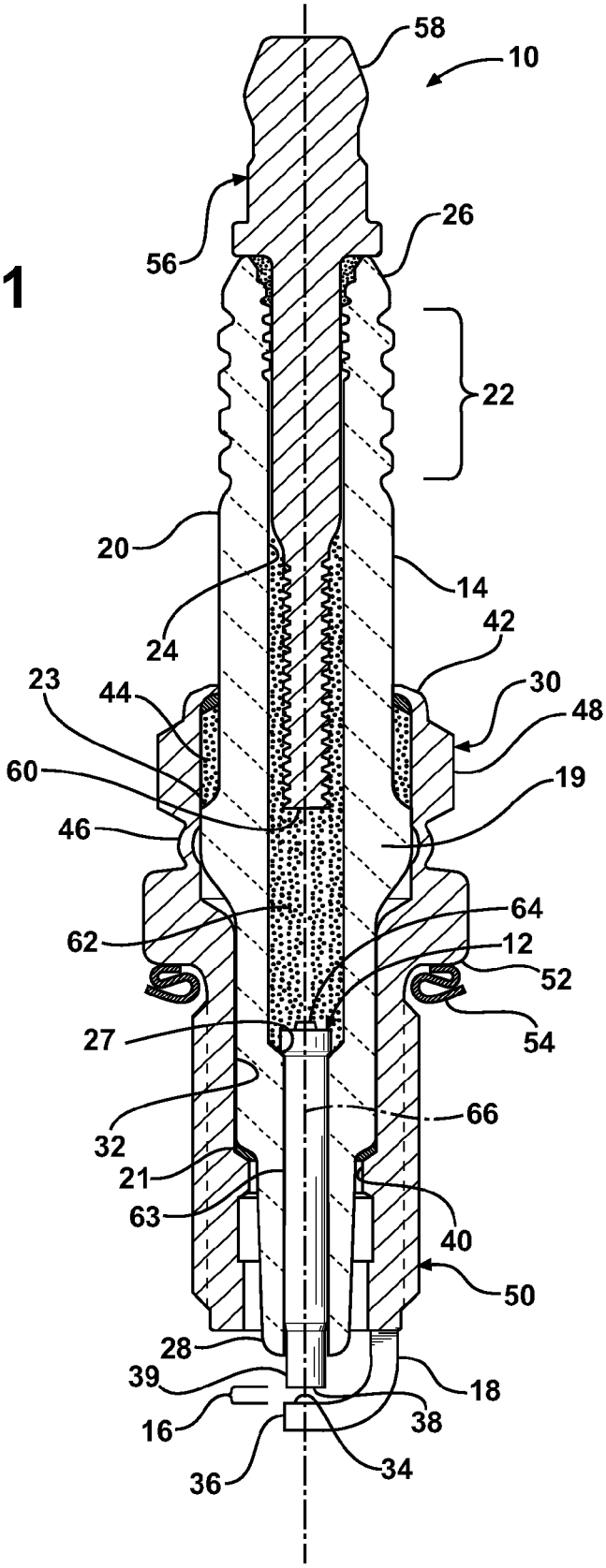
FIG. 1 is a cross-sectional view of a spark plug constructed in accordance with one presently preferred aspect of the invention.

Referring in more detail to the drawings, FIG. 1 illustrates a spark ignition device, referred to hereafter as spark plug, generally at 10 used for igniting a fuel/air mixture within an internal combustion engine (not shown). The spark plug 10 has a center electrode 12 constructed of a conductive or semi-conductive ceramic material in accordance with the invention. The ceramic materials used for the center electrode 12 are capable of withstanding the most extreme temperature, pressure, chemical corrosion and physical erosion conditions experienced by the spark plug 10. These conditions include exposure to numerous high temperature chemical reactant species associated with the combustion process which commonly promote oxidation, sulfidation and other high temperature corrosion processes, such as those attributed to calcium and phosphorus in the combustion products, as well as reaction of the plasma associated with the spark kernel and flame front which promote erosion of the spark surface of the electrode 12. The center electrode 12 substantially avoids cyclic thermo-mechanical stresses typically otherwise associated with a mismatch in the thermal expansion coefficients of the common metal alloy electrode materials and associated components of the spark plug 10, such as an insulator 14, given the insulator 14 is also constructed from a ceramic material. Accordingly, the electrode 12 avoids high temperature creep deformation, cracking and fracture phenomena, which typically results in failure of electrodes. In addition, with the center electrode 12 being able to withstand or avoid the aforementioned conditions, a preset spark gap 16 between the center electrode 12 and a ground electrode 18 is able to be substantially maintained over the life of the vehicle. As such, the formation, location, shape, duration and other characteristics of the spark generated across the spark gap 16 is able to be optimized over the useful life of the spark plug 10. In turn, the combustion characteristics of the fuel/air mixture and performance characteristics of the engine in which the spark plug 10 is incorporated is able to be optimized.

The spark plug 10 includes the generally annular ceramic insulator 14, which may include aluminum oxide or another suitable electrically insulating material having a specified dielectric strength, high mechanical strength, high thermal conductivity, and excellent resistance to thermal shock. The insulator 14 may be press molded from a ceramic powder in a green state and then sintered at a high temperature sufficient to densify and sinter the ceramic powder. The insulator 12 has an outer surface which may include a lower portion 19 having a small lower shoulder 21 and a large upper shoulder 23, with a partially exposed upper mast portion 20 extending upwardly from the upper shoulder 23 to which a rubber or other insulating spark plug boot (not shown) surrounds and grips to electrically isolate an electrical connection with an ignition wire and system (not shown). The exposed mast portion 10 may include a series of ribs 22 or other surface glazing or features to provide added protection against spark or secondary voltage flash-over and to improve the gripping action of the mast portion 20 with the spark plug boot. The insulator 14 is of generally tubular or annular construction, including a central passage 24 extending longitudinally between an upper terminal end 26 and a lower core nose end 28. With respect to the embodiment of FIG. 1, the central passage 24 has a varying cross-sectional area, generally greatest at or adjacent the terminal end 26 and smallest at or adjacent the core nose end 28, with a transition shoulder 27 therebetween, although other passage configurations are possible and contemplated to be within accordance of the invention.

The spark plug includes an electrically conductive metal shell 30. The metal shell 30 may be made from any suitable metal, including various coated and uncoated steel alloys. The shell 30 has a generally annular interior surface 32 which surrounds and is adapted for sealing engagement with the outer surface of the lower portion 19 of the insulator 14 and has the ground electrode 18 attached thereto which is maintained at ground potential. While the ground electrode 18 is depicted in a commonly used single L-shaped style, it will be appreciated that multiple ground electrodes of straight, bent, annular, trochoidal and other configurations can be substituted depending upon the intended application for the spark plug 10, including two, three and four ground electrode configurations, and those where the electrodes are joined together by annular rings and other structures used to achieve particular sparking surface configurations. The ground electrode 18 has one or more ground electrode firing or sparking surface 34 on a sparking end 36 proximate to and partially bounding the spark gap 16 located between the ground electrode 18 and the center electrode 12, which also has an associated center electrode sparking surface 38. The spark gap 16 may constitute an end gap, side gap or surface gap, or combinations thereof, depending on the relative orientation of the electrodes and their respective sparking ends and surfaces. The ground electrode sparking surface 34 and the center electrode sparking surface 38 may each have any suitable cross-sectional shape, including round, rectangular, square and other shapes, and the shapes of these sparking surfaces may be different.

The shell 30 is generally tubular or annular in its body section and includes an internal lower compression flange 40 configured to bear in pressing contact against the small mating lower shoulder 21 of the insulator 14 and an upper compression flange 42 that is crimped or formed over during the assembly operation to bear on the large upper shoulder 23 of the insulator 14 via an intermediate packing material 44. The shell 30 may also include an annular deformable region 46 which is designed and configured to collapse axially and radially outwardly in response to heating of the deformable zone 46 and associated application of an overwhelming axial compressive force during or subsequent to the deformation of the upper compression flange 42 in order to hold the shell 30 in a fixed axial position with respect to the insulator 14 and form a gas tight radial seal between the insulator 14 and the shell 30. Gaskets, cement, or other packing or sealing compounds can also be interposed between the insulator 14 and the shell 30 to perfect a gas-tight seal and to improve the structural integrity of assembled spark plug 10.

The shell 30 may be provided with an external tool receiving hexagon 48 or other feature for removal and installation of the spark plug in a combustion chamber opening. The feature size will preferably conform with an industry standard tool size of this type for the related application. Of course, some applications may call for a tool receiving interface other than a hexagon, such as slots to receive a spanner wrench, or other features such as are known in racing spark plug and other applications. A threaded section 50 is formed on the lower portion of the shell 30, immediately below a sealing seat 52.

The sealing seat 52 may be paired with a gasket 54 to provide a suitable interface against which the spark plug 10 seats and provides a hot gas seal of the space between the outer surface of the shell 30 and the threaded bore in the combustion chamber opening. Alternately, the sealing seat 52 may be configured as a tapered seat located along the lower portion of the shell 30 to provide a close tolerance and a self-sealing installation in a cylinder head which is also designed with a mating taper for this style of spark plug seat.

An electrically conductive terminal stud 56 is partially disposed in the terminal end 26 of the central passage 24 of the insulator 14 and extends longitudinally from an exposed top post 58 to a bottom end 60 embedded partway down the central passage 24. The top post 58 is configured for connection to an ignition wire (not shown) which is typically received in an electrically isolating boot as described herein and receives timed discharges of high voltage electricity required to fire the spark plug 10 by generating a spark across the spark gap 54.

The bottom end 60 of the terminal stud 56 is preferably reduced in diameter from the central passage 24 and is embedded within a conductive glass seal 62. The conductive glass seal 62 functions to seal the bottom end 60 of terminal stud 40 and the central passage 24 from combustion gas leakage and to electrically establish an electrical connection between the terminal stud 56 and the center electrode 12. Many other configurations of glass and other seals are well-known and may also be used in accordance with the invention. In addition, although not believed necessary in lieu of the construction of the center electrode 12, a resistor layer (not shown), as is known, made from any suitable composition known to reduce electromagnetic interference ("EMI"), could be disposed between the bottom end 60 of the terminal stud 56 and an upper end or head 64 of the center electrode 12. Accordingly, an electrical charge from the ignition system travels through the bottom end 60 of the terminal stud 56, through the glass seal 62, and through the center electrode 12.

The center electrode 12 is partially disposed in central passage 24 of the insulator 14 and has an elongate cylindrical body 63, that extends along a longitudinal axis 66 from its enlarged, radially outwardly flared head 64, which is known in headed pin configurations, wherein the head 64 is encased in the glass seal 62 and generally in abutment with the transition shoulder 27, to its sparking end 39 which projects outwardly from the nose end 28 of the insulator 14 proximate, but spaced from, the sparking surface 34 of the ground electrode 18. The body 63 of the center electrode 12 is constructed as a solid, one-piece, monolithic conductive or semi-conductive ceramic structure extending continuously and uninterrupted between its head 64 and its sparking end 39. The ceramic structure of the body 63 may be constructed of various grades of material, thereby providing the body 63 with the desired levels of electrical resistance, depending on the application and desired characteristics, such as the desired electrical resistance for suppression of RF electromagnetic radiation. The body 63 may be constructed of one of various ceramic materials, such as, by way of example and without limitation, oxides of transition metals (including monoxides such as TiO; VO; NbO; TaO; MnO; FeO; CoO; NiO; CuO and ZnO: including sesquioxides such as $V_2O_3$; $CrO_3$; $Fe_2O_3$; $RhO_3$; $In_2O_3$; $Th_2O_3$ and $Ga_2O_3$: further including dioxides such as $TiO_2$; $V_2O_3$; $CrO_2$; $MoO_2$; $WO_2$; $RuO_2$; $ReO_2$; $OsO_2$; $RhO_2$; $IrO_2$; $PbO_2$; $NbO_2$; $MbO_2$; $MnO_2$; $PtO_2$; $GeO_2$ and $SnO_2$); further including oxides of two or more metals which include at least one transition metal, including for example, perovskite structures with the general formulation $A_xB_{1-x}O_3$, where B is Sc, Ti, Zr, Hf, Nb, Ta, Mo, W, Re, V, Cr, Mn, Tc, Fe, Ru, Co, Rh, Ni and where A is La, Ca, Ba, Sr, Y, or Gd, with some examples being ($LaCrO_3$; $LaMnO_3$; $LaFeO_3$; $LaGaO_3$ and $LaCo_3$); borides, including for example chemical compositions having the formula $M_xB_y$, where M is a metallic element, X is often 1, and Y is often 1, 2 or 6: borides have an electrical resistance in the range of $10^{-5}$ to $10^{-4}$ ohm-cm, and melting points in the range of 1600 to 3200 degrees Celcius: some examples include Zirconium Boride ($ZrB_2$; ZrB and $ZrB_{12}$); Hafnium Boride ($HfB_2$); Titanium Boride ($TiB_2$; TiB); Vanadium Boride ($VB_2$; VB); Tungsten Boride ($W_2B_5$); Chromium Boride ($CrB_2$; CrB); Molybdenum Boride beta-MoB, alpha-MoB, $Mo_2B_5$; $Mo_2B$; Niobium Boride ($NbB_2$; NbB); Tantalum Boride ($TaB_2$; TaB); Lanthanum Hexaboride ($LaB_6$); Barium Hexaboride ($BaB_6$); Calcium Hexaboride ($CaB_6$); Cerium Hexaboride ($CeB_6$); nitrides, including for example chemical compositions having the formula $M_xN_y$, where M is a metallic element, N is nitride and X and Y are typically 1, the nitrides have an electrical resistance in the range of $10^{-5}$ to $10^{4}$ ohm-cm, and melting points in the range of 1400 to 3300 degrees Celcius: some examples include, Titanium Nitride (TiN); Zirconium Nitride (ZrN); Tantalum Nitride (TaN); Niobium Nitride (NbN); Vanadium Nitride (VN); Hafnium Nitride (HfN): carbides, including for example chemical compositions having the formula $M_xC_y$, where M is a metallic element, C is carbon and X and Y are typically 1, the carbides typically have an electrical resistance in the range of $10^{-5}$ to $10^{-4}$ ohm-cm, and melting or sublimation points in the range of 1900 to 4000 degrees Celcius: some examples include, Tantalum Carbide (TaC); Chromium Carbide ($Cr_3C_2$); Molybdenum Carbide (MoC; $Mo_2C$); Tungsten Carbide (WC; $W_2C$); Zirconium Carbide (ZrC); Titanium Carbide (TiC); Niobium Carbide (NbC); Hafnium Carbide (HfC); Vanadium Carbide (VC); Beryllium Carbide ($Be_2C$); Silicon Carbide (SiC); Boron Carbide ($B_4C$): and silicides, including for example chemical compositions having the formula $M_xSi_y$, where M is a metallic element, Si is silicon and X is typically 1 and Y is typically 2, the silicides typically have an electrical resistance in the range of $10^{-5}$ to $10^{-4}$ ohm-cm, and melting points in the range of 1500 to 2500 degrees Celcius: some examples include, Molybdenum Silicide ($MoSi_2$); Niobium Silicide ($NbSi_2$); Titanium Silicide ($TiSi_2$); Tungsten Silicide ($WSi_2$; $W_5Si_2$); Chromium Silicide ($CrSi_2$; $Cr_3Si$); Tantalum Silicide ($TaSi_2$). Other compounds may include ternary silicides, nitrides and carbides, such as Molybdenum Silicide Carbide ($Mo_5Si_3C$) or Titanium Carbonitride (TiCN), for example.

Accordingly, depending on the level of resistance of the electrode 12 desired and the temperatures to which the electrode 12 is exposed, the appropriate ceramic material can be used in the construction of the electrode 12 as desired. Further, the ceramic material can be provided as a homogeneous material over the entire structure of the center electrode 12.

Figure 2:
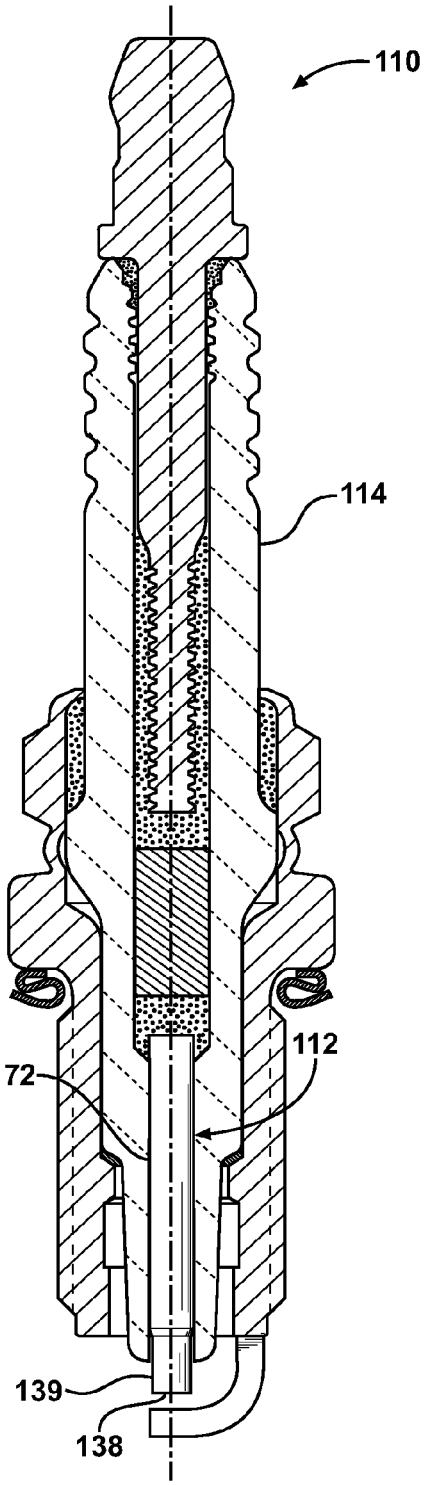
FIG. 2 is a cross-sectional view of a spark plug constructed in accordance with another presently preferred aspect of the invention.
Figure 3:
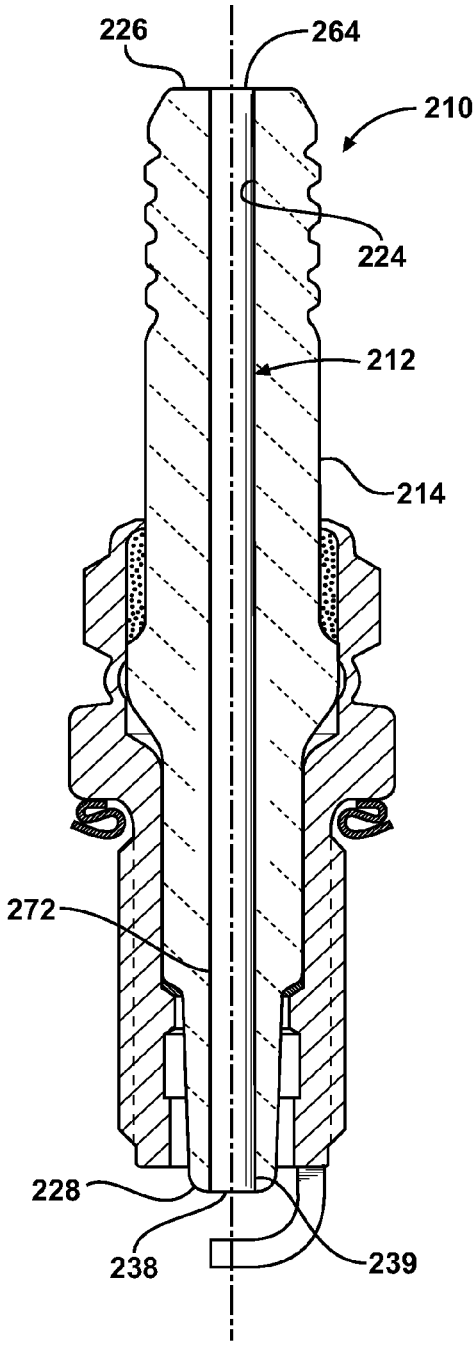
FIG. 3 is a cross-sectional view of a spark plug constructed in accordance with yet another presently preferred aspect of the invention.

While the center electrode 12 is illustrated in FIG. 1 having a headed pin configuration due to the flared upper end or head 64, the invention also encompasses all manner of headed arrangements with the head at the opposite end of the electrode (i.e., proximate the sparking end 39). In addition, as illustrated in FIG. 2, wherein reference numerals offset by a factor of 100 are used to identify similar features as described above, an electrode 112 of a spark plug 110 can be constructed as straight cylindrical configuration, thereby being well suited to be formed in an extruding process and co-fired or sintered along with an insulator 114 to permanently bond the electrode 112 to the insulator ceramic material via an as sintered bond represented generally at 72. Accordingly, the insulator 114 and electrode 112 can be constructed as a unitary subassembly that is economical in manufacture. In addition, as illustrated in FIG. 3, wherein reference numerals offset by a factor of 200 are used to identify similar features as described above, an electrode 212 of a spark plug 210 can be constructed as a straight cylindrical configuration having an outer surface with a constant or substantially constant diameter extending over a length sufficient to extend through the entire length of a central passage 224 within an insulator 214 of the spark plug. Accordingly, the central passage 224 of the insulator 214 can be formed as a cylindrical though passage of a constant or substantially constant diameter, and sized for close, pressing receipt of the electrode 212, wherein the opposite ends 264, 239 of the electrode 212 are flush or substantially flush with the opposite terminal and nose ends 226, 228 of the insulator 214. Accordingly, the spark plug 210 does not have the conventional central resistor layer and glass sealing, as the electrode 212 extends completely through the passage 224 and performs the desired electrical resistance, depending on the ceramic material used to construct the electrode 212. Further, as with the electrode 112, the electrode 212 can be co-fired or sintered with the insulator 214 to permanently bond the electrode 212 to the insulator ceramic material via an as sintered bond represented generally at 272. Accordingly, the insulator 214 and electrode 212 can be constructed as a unitary subassembly that is economical in manufacture. It should be recognized that as well as those configurations illustrated, that the diameter of the electrode can be constructed to vary along its length, either in a stepwise, tapered or other manner, as desired. The center electrode 12, 112, 212 may have any suitable cross-sectional size or shape, including circular, square, rectangular, or otherwise or size. Further, the sparking end 39, 139, 239 may have any suitable shape. It may have a reduced cross-sectional size, and may have a cross-sectional shape that is different than the other portions of the center electrode. The sparking surface 38, 138, 238 may be any suitable shape, including flat, curved, tapered, pointed, faceted or otherwise.

The center electrode 12 of the invention may be made using any suitable method for making ceramic articles of the types described, including injection molding and sintering, or pressing and sintering.

Obviously, many modifications and variations of the present invention are possible in light of the above teachings. It is, therefore, to be understood that within the scope of the appended claims, the invention may be practiced otherwise than as specifically described.

What is claimed is:

1. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material; and wherein said ceramic material comprises nitrides.

2. The spark plug of claim 1 wherein said nitrides have a chemical composition of the formula $M_xN_y$ where M is a metallic element, N is nitride and X and Y are 1.

3. The spark plug of claim 1 wherein said nitrides are selected from the group consisting of TiN, ZrN, TaN, NbN, VN and HfN.

4. The spark plug of claim 1 wherein said nitrides include TiCN.

5. The spark plug of claim 1 including a glass seal being conductive and disposed in said central passage, and wherein said insulator includes a transition shoulder between said ends, said center electrode includes a head abutting said transition shoulder and encased in said glass seal, said elongate body of said center electrode extends longitudinally from said head.

6. The spark plug of claim 1 further comprising a sintered bond connecting said center electrode to said insulator.

7. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material; and wherein said ceramic material comprises silicides; and wherein said silicides include $Mo_5Si_3C$.

8. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material;

wherein said ceramic material comprises oxides; and wherein said oxides are selected from the group consisting of TiO, VO, NbO, TaO, MnO, FeO, CoO, NiO, CuO, $V_2O_3$, $CrO_3$, $Fe_2O_3$, $RhO_3$, $In_2O_3$, $Th_2O_3$, $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$, $GeO_2$, $SnO_2$, and perovskite structures with the general formulation $A_xB_{1-x}O_3$, where B is one of Sc, Ti, Zr, Hf, Nb, Ta, Mo, W, Re, V, Cr, Mn, Tc, Fe, Ru, Co, Rh, Ni and where A is one of La, Ca, Ba, Sr, Y, Gd.

9. The spark plug of claim 8 wherein said ceramic material is homogenous throughout said body.

10. The spark plug of claim 9 wherein said body is a monolithic piece of said ceramic material.

11. The spark plug of claim 8 further comprising a sintered bond connecting said center electrode to said insulator.

12. The spark plug of claim 8 wherein said center electrode has a cylindrical outer surface of a substantially constant diameter.

13. The spark plug of claim 8 wherein an end of said center electrode is substantially flush with said nose end of said insulator.

14. The spark plug of claim 13 wherein said center electrode has a cylindrical outer surface of a substantially constant diameter.

15. The spark plug of claim 8 wherein said center electrode provides electrical resistance.

16. The center electrode of claim 8 including a separate resistor component coupled to an end of said ends of said central electrode.

17. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material;

wherein said ceramic material is a homogeneous material consisting of carbides; and including a glass seal being conductive and disposed in said central passage, and wherein said insulator includes a transition shoulder between said ends, said center electrode includes a head abutting said transition shoulder and encased in said glass seal, said elongate body of said center electrode extends longitudinally from said head.

18. The spark plug of claim 17 wherein said carbides have a chemical composition of the formula $M_xC_y$, where M is a metallic element, C is carbon and X and Y are 1.

19. The spark plug of claim 17 wherein said carbides are selected from the group consisting of TaC, $Cr_3C_2$, MoC, $Mo_2C$, WC, $W_2C$, ZrC, TiC, NbC, HfC, VC, $Be_2C$, SiC, and $B_4C$.

20. The spark plug of claim 17 further comprising a sintered bond connecting said center electrode to said insulator.

21. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material;

wherein said ceramic material comprises silicides; and including a glass seal being conductive and disposed in said central passage, and wherein said insulator includes a transition shoulder between said ends, said center electrode includes a head abutting said transition shoulder and encased in said glass seal, said elongate body of said center electrode extends longitudinally from said head.

22. The spark plug of claim 21 wherein said silicides have a chemical composition of the formula $M_xSi_y$, where M is a metallic element, Si is silicon and X is 1 and Y is 2.

23. The spark plug of claim 21 wherein said silicides are selected from the group consisting of ($MoSi_2$), $NbSi_2$, $TiSi_2$, $WSi_2$, $W_5Si_2$, $CrSi_2$, $Cr_3Si$, and $TaSi_2$.

24. The spark plug of claim 21 further comprising a sintered bond connecting said center electrode to said insulator.

25. A spark plug comprising a ceramic insulator extending along a longitudinal axis and presenting a central passage between a terminal end and a nose end;

a center electrode disposed in said central passage of said insulator;

said center electrode including an elongate body constructed of a ceramic material;

wherein said ceramic material comprises oxides selected from the group consisting of TiO, VO, NbO, TaO, MnO, FeO, CoO, NiO, CuO, ZnO, $V_2O_3$, $CrO_3$, $Fe_2O_3$, $RhO_3$, $In_2O_3$, $Th_2O_3$, $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$ $GeO_2$, $SnO_2$ and perovskite structures with the general formulation $A_xB_{1-x}O_3$, where B is one of Sc, Ti, Zr, Hf, Nb, Ta, Mo, W, Re, V, Cr, Mn, Tc, Fe, Ru, Co, Rh, Ni and where A is one of La, Ca, Ba, Sr, Y, Gd; and including a glass seal being conductive and disposed in said central passage, and wherein said insulator includes a transition shoulder between said ends, said center electrode includes a head abutting said transition shoulder and encased in said glass seal, said elongate body of said center electrode extends longitudinally from said head.

26. The spark plug of claim 25 wherein said glass seal is a resistor component coupled to said center electrode for suppressing radio frequency (RF) electromagnetic radiation.

27. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material;

wherein said ceramic material is a homogeneous material consisting of carbides; and wherein said carbides include a compound selected from the group consisting of $Mo_5Si_3C$ and TiCN.

28. A spark plug comprising:

a ceramic insulator extending along a longitudinal axis and presenting a central passage between a terminal end and a nose end;

a center electrode disposed in said central passage of said insulator;

said center electrode including an elongate body constructed of a ceramic material; and wherein said ceramic material comprises silicides; and wherein said silicides include $Mo_5Si_3C$.

* * * * *